United States Patent [19]

Hickman et al.

[11] Patent Number: 4,626,636

[45] Date of Patent: Dec. 2, 1986

[54] PRESSURE OPERATED SWITCH ASSEMBLY WITH EXTERNAL PRESSURE CONTROL

[75] Inventors: Ronald J. Hickman, Rochester; John M. Gerula, Chatham, both of Ill.

[73] Assignee: Stewart-Warner Corporation, Chicago, Ill.

[21] Appl. No.: 715,837

[22] Filed: Mar. 25, 1985

[51] Int. Cl.[4] ..... H01H 35/34

[52] U.S. Cl. ..... 200/83 P; 200/83 S; 200/308; 73/723

[58] Field of Search ..... 116/DIG. 7, 70, 266, 116/268; 73/717, 723; 200/56 R, 308, 302.1, 67 B, 83 P, 83 S, 83 SA, 83 J, 83 R, 81 R

[56] References Cited

U.S. PATENT DOCUMENTS

| | | | |
|---|---|---|---|
| 3,022,396 | 2/1962 | Packer | 200/83 S |
| 3,364,321 | 1/1968 | Gessner | 200/83 S |
| 4,168,415 | 9/1979 | Edwards, Jr. | 200/308 |
| 4,272,660 | 6/1981 | Mayer | 200/83 P |

*Primary Examiner*—G. P. Tolin

*Attorney, Agent, or Firm*—A. G. Douvas; D. V. Allen

[57] ABSTRACT

A pressure-operated electric switch assembly of the diaphragm type wherein a housing mounted diaphragm actuates a snap action switch adjustable in the housing to vary the switch operating pressure. The pressure setting may be varied externally by the user upon manual rotation of a switch sealing boot and the setting may be visually observed from indicia surrounding the housing that cooperate with a pointer on the boot.

7 Claims, 8 Drawing Figures

PRESSURE OPERATED SWITCH ASSEMBLY WITH EXTERNAL PRESSURE CONTROL

BACKGROUND OF THE INVENTION

Snap-action type electric switches have found considerable success for a long period of time in applications where power load levels are substantial. Most of these snap-action switches employ a movable contact element that traverses between two stationary contacts, and a coiled spring that biases the movable contact toward each of the stationary contacts depending upon which side of a central position the movable contact is in. This over-center spring geometry moves the movable contact very rapidly toward and away from the stationary contacts, minimizing the possibility of contact dithering and arcing, as well as contact welding.

Such switches inherently have considerable hysteresis, i.e. switch contacts will "make" at a given point in the travel of the switch actuator and "break" at a different position of the actuator. If such a switch is operated by a pressure-responsive diaphragm, this make-and-break differential may, for example, cause the switch to actuate at 7 psi but not deactuate until pressure falls to 6 psi. This minimizes dithering of the switch contacts. Such a pressure operated switch is illustrated and described in the Mayer U.S. Pat. No. 4,272,660, assigned to the assignee of the present invention.

The make-and-break pressure settings for diaphragm-operated pressure switches can be adjusted in a variety of ways, such as varying diaphragm geometry, varying the length of the actuating elements in the switch, as well as varying diaphram vs. switch position. However, as far as Applicant is aware, these variations are usually made by the manufacturer of the switch assembly and are not intended to nor may they be readily varied by the ultimate user of the switch.

In some applications, however, it is desirable that the ultimate user of the switch be permitted to vary the switch operating pressure. One such application is in the control of heating units for swimming pool and spa water heating systems. Such systems include electric heating elements across which water conduits pass in and out of contact heat exchange relation. To prevent damage to the heating elements it is desirable that they be shut off when water flow through the heat exchange conduits falls below a predetermined level. Since the rate of water flow varies from one system to another and is in fact variable in many individual systems, it is desirable to afford the ultimate user and the installer and opportunity to adjust the pressure setting at which the heating unit is de- energized.

It is also desirable that the switch assembly be sealed in this environment from the corrosive and other deleterious effects of the swimming pool environment.

However, to date no pressure switch assembly has been provided that is readily adjustable after installation and which is sealed from its environs.

It is therefore a primary object of the present invention to ameliorate the problems noted above in pressure operated switch assemblies.

SUMMARY OF THE INVENTION

According to the present invention a pressure operated electric switch assembly is provided with a unitary switch sub-assembly easily axially adjusted by the user to vary the pressure setting of the switch, and also provided with an external indicator to tell the user what the pressure setting is, both accomplished in part by a multi-function sealing boot that additionally isolates the switch from the deleterious effects of its environment.

Toward these ends a cup-shaped housing is provided with a pressure chamber in which a diaphragm is mounted that responds to a predetermined chamber pressure to actuate a completely unitary switch sub-assembly mounted in the housing, through an axially reciprocable plunger.

The unitary switch sub-assembly is completely self-contained and self-enclosed and is inserted into the cup-shaped portion of the housing as a unit during manufacture. The switch unit includes a base with external threads that threadedly engage internal threads in the housing so that upon rotation of the switch unit, the axial position of the switch unit in the housing is varied and this in turn varies the switch operating pressure, i.e. the pressure required in the diaphragm chamber to move the movable switch contact from one stationary contact to the other. The switch base has a terminal portion that projects from the housing and is completely enclosed by an elastomeric boot that seals the switch assembly in the housing.

This boot has a rectangular base that serves as the operating "handle" for the user to rotate the switch base to vary the switch set point. The boot has an upper ring with an integral indicator pointer that cooperates with indicia on a stationary ring surrounding the housing to provide the user with a visual indication of switch operating pressure.

DETAILED DESCRIPTION OF THE PREFERRED EMBODIMENT

Figure 1:
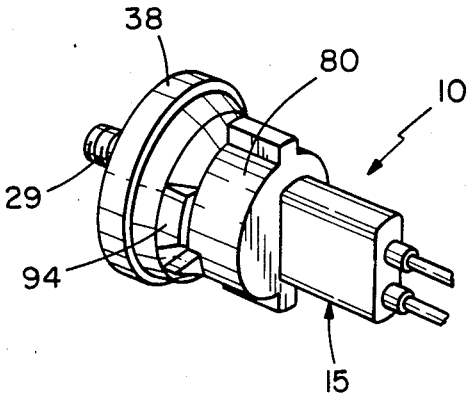
FIG. 1 is a perspective view of a pressure operated switch according to the present invention.
Figure 4:
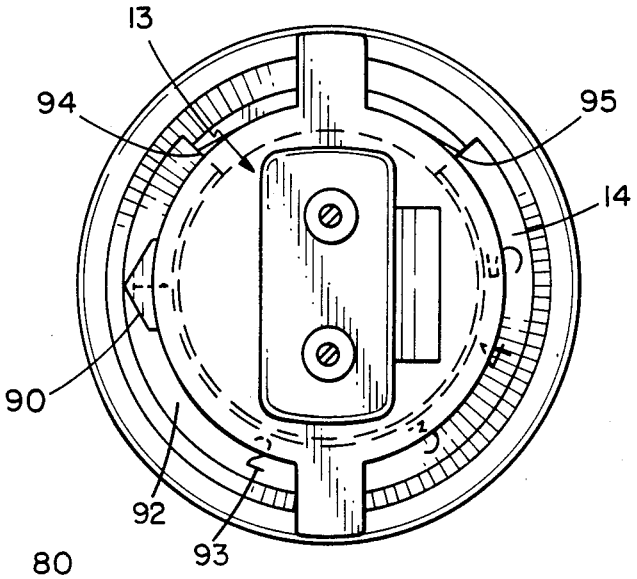
FIG. 4 is a bottom view of the pressure operated switch illustrated in FIGS. 1 to 3.
Figure 2:
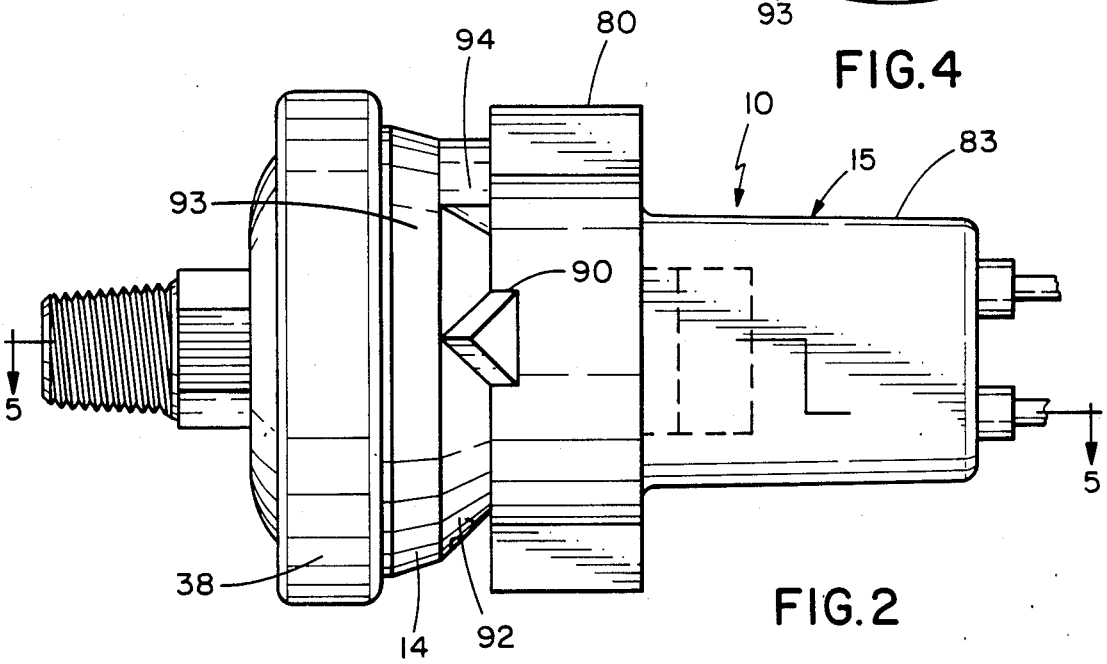
FIG. 2 is an enlarged front view of the pressure operated switch illustrated in FIG. 1.
Figure 3:
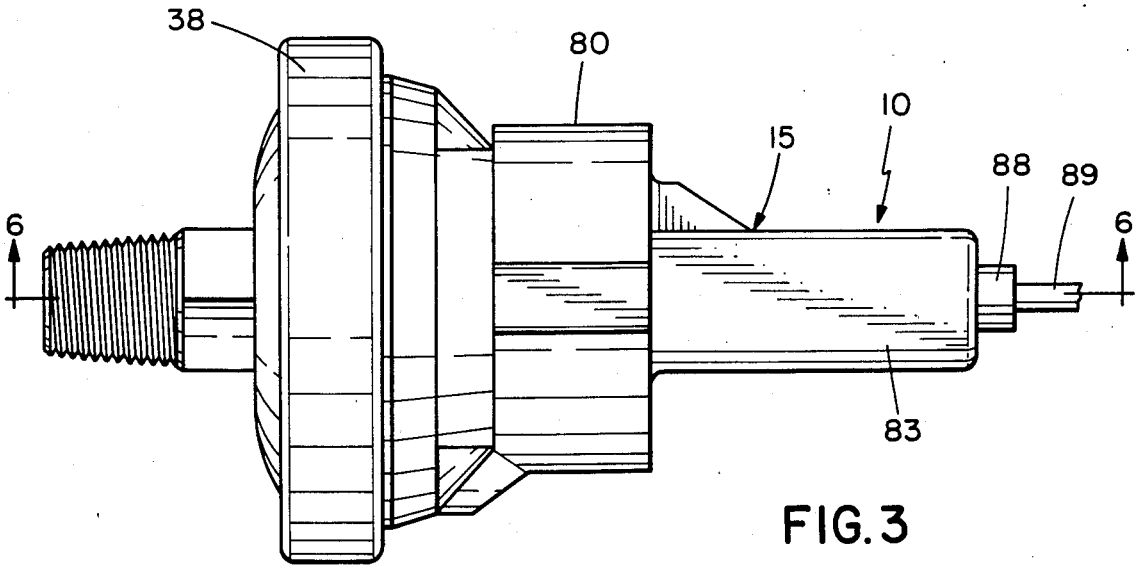
FIG. 3 is an enlarged side view of the pressure operated switch illustrated in FIG. 1.

Referring to the drawings and particularly FIGS. 1 to 6, a pressure operated electric switch according to the present invention is illustrated, designated generally by the reference numeral 10 and is seen to include a cup-shaped housing 11 in which a unitary switch assembly 12 is axially adjustable, a pressure operated diaphragm assembly 13 mounted on top of the cup-shaped housing 11 that operates the switch assembly 12, and an elastomeric boot 15 that seals the switch 12 from water ingress and cooperates with an indicia ring 14 surrounding housing 12 to provide the user with a visual representation of switch set point pressure.

Terminals 16 and 17 are connected to the load element and supply respectively. Terminal 18 while not connected to a lead in the drawings, may also be employed in certain applications where the other stationary contact in switch 12 is needed.

The switch assembly 10 is particularly adapted to sense water flow through a swimming pool or spa heating element and is designed to shut off the heating elements at a predetermined water pressure. However, the switch assembly has other applications, particularly where a corrosive or humid environment is found.

The housing 11 is a one-piece member of cup-shaped configuration having a stepped bore 20 including an enlarged portion 21 at the open end of the housing, an intermediate threaded portion 22 for slidably receiving the switch assembly 12, and a reduced portion 24 that provides communication between the interior of the housing 11 and the diaphragm assembly 13. The upper end of housing 11 has an integral annular flange 25 that defines a seating surface 26 for diaphragm supporting seal 27 that is part of the diaphragm assembly 13.

The diaphragm assembly 13 includes a threaded brass inlet connector 29 having an inlet passage 30 therethrough connected to a bell-shaped cover plate 32. The cover plate 32 defines a pressure chamber 33 with diaphragm 34. The bell-shaped cover 32, gasket 36, diaphragm 34 and seal 27 are sandwiched and held together on housing seating surface 26 by an annular retainer 38 that is roll staked around the upper surface of the cover 32 and the lower surface of the housing projection 25.

The diaphragm 34 may, for example, be on the order of 0.004 inches and is flat except for a semi-torroidal portion 39.

Inlet fitting 29 is adapted to be connected directly to the pool or spa water line directed through the heating elements so that chamber 33 is filled with water.

The switch sub-assembly 12 is an integral unit that is inserted as a unit into the housing 11 in assembly. This sub-assembly is seen to include a cylindrical base 40 with a threaded portion 46 threadedly engaged with threads 22 in the housing 11. Base 40 is a plastic molding having an integral generally rectangular terminal end 42 projecting from housing 11 and in which terminals 16 and 17 are insert-molded. The upper end 48 of terminal 16 is bent over 90 degrees and carries upper fixed contact 49.

The upper end 51 of unused terminal 18 is bent over 90 degrees and carries lower fixed contact 52. The upper end of terminal 17 is connected to support post 53.

Figure 5:
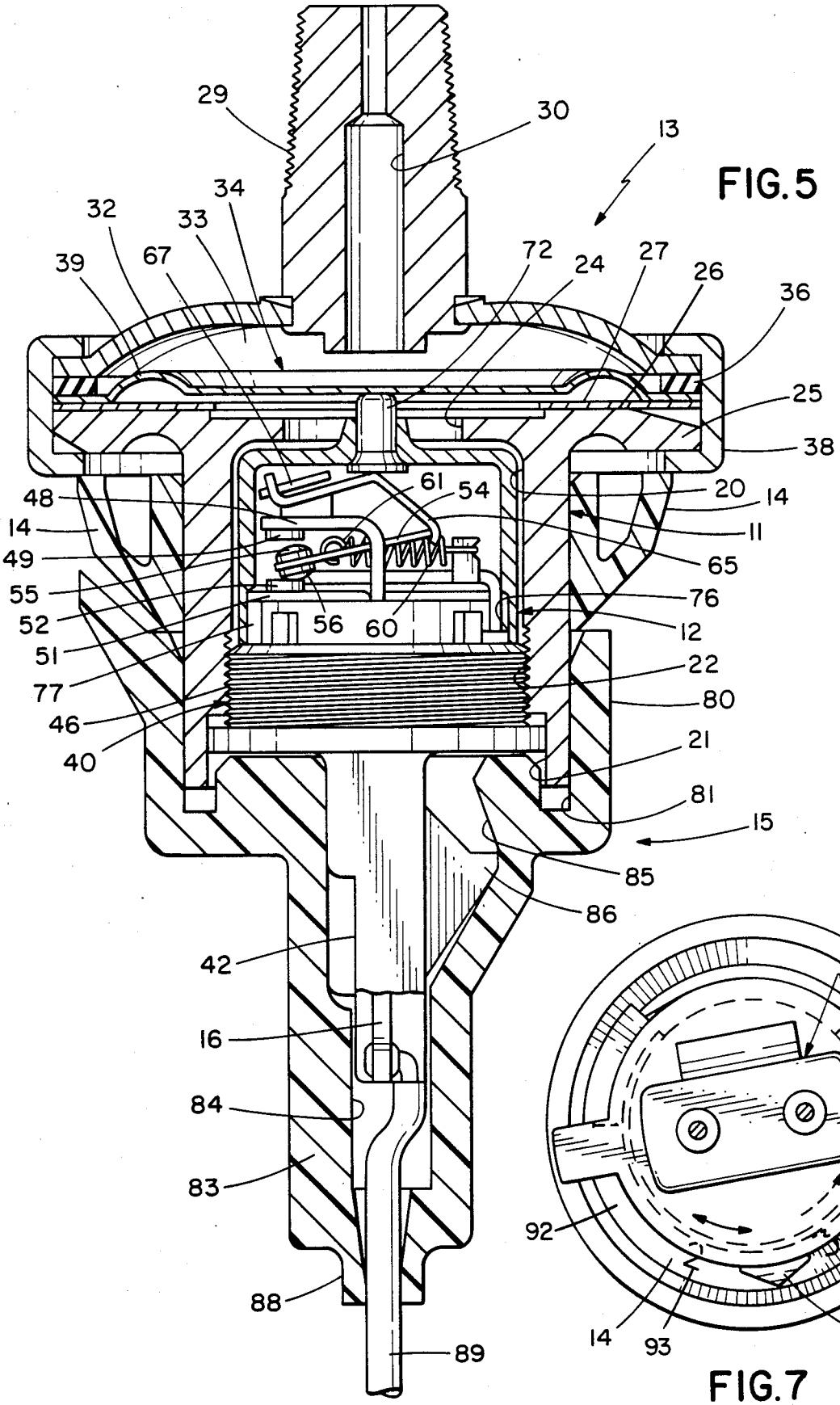
FIG. 5 is an enlarged longitudinal section of the switch taken generally along line 5—5 of FIG. 2.
Figure 7:
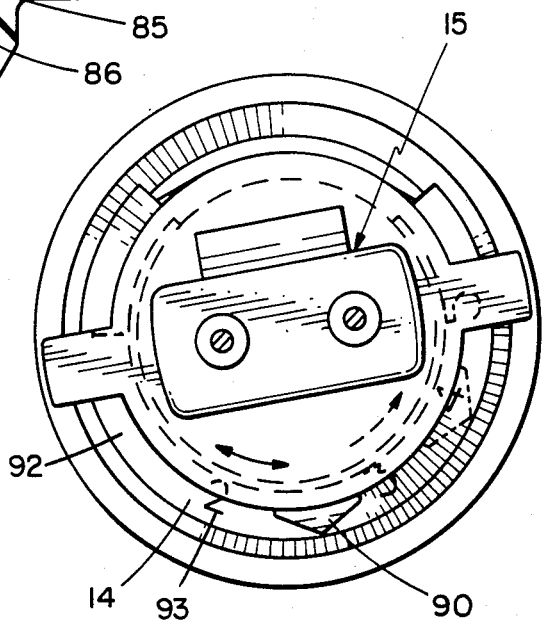
FIG. 7 is a bottom view of the pressure operated switch according to the present invention with the switch boot rotated with respect to the housing somewhat more than 90 degrees counter-clockwise from its position illustrated in FIG. 4.
Figures 6, 8:
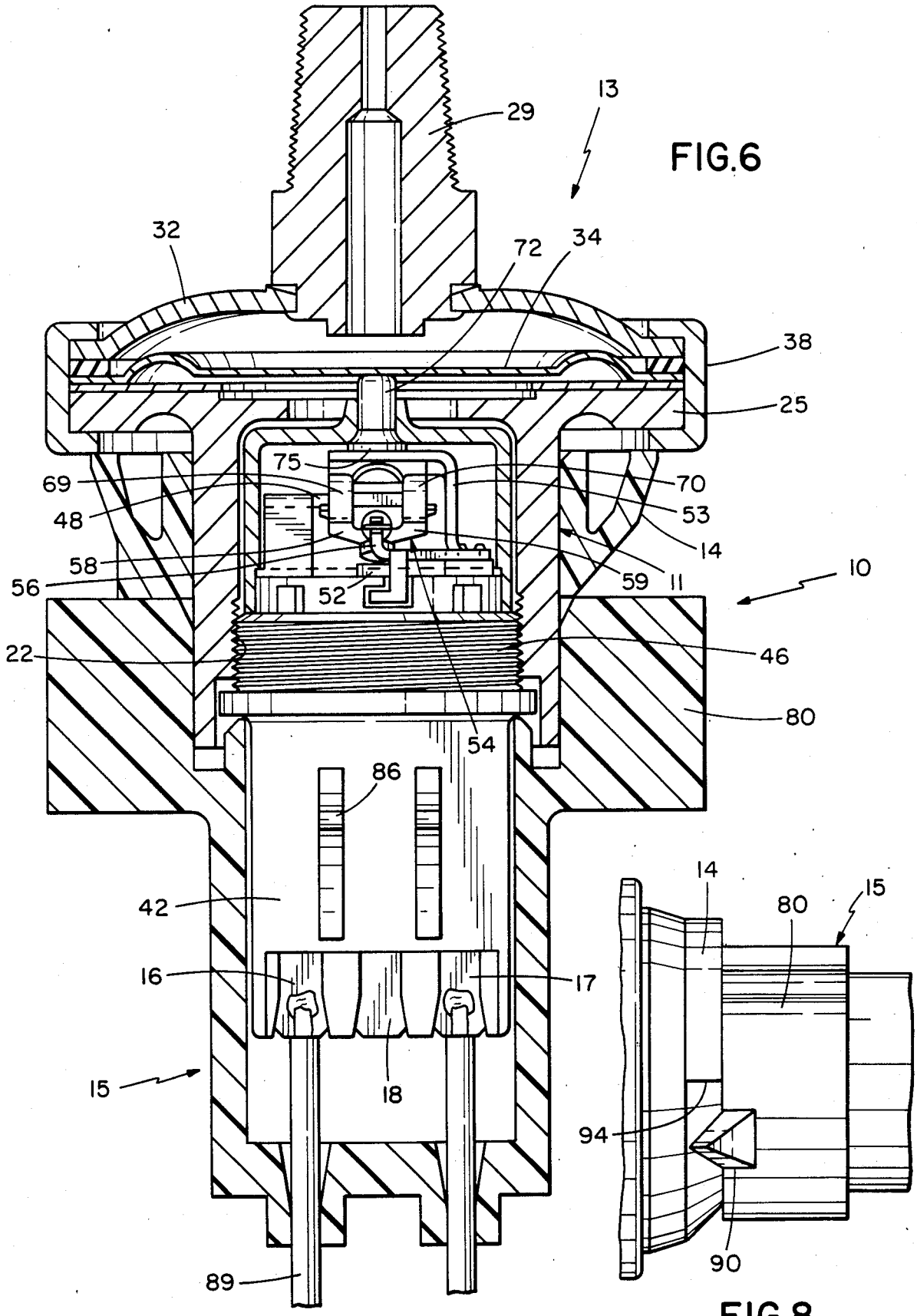
FIG. 6 is an enlarged longitudinal section of the switch taken generally along line 6—6 of FIG. 3, in a plane generally perpendicular to the plane of FIG. 5.
FIG. 8 is a fragmentary view of the boot indicator rotated to its minimum pressure setting position.

The movable contact for the switch is provided by a flat bifurcated contact blade 54 having upper and lower contacts 55 and 56 at the end thereof, engageable selectively with fixed contacts 49 and 52, as best seen in FIGS. 5 and 6. The contact blade 54 has spaced legs 58 and 59 that permit the blade to receive an over-center spring 60 with a hooked end 61 extending through a hole in the blade 54.

Spring 60 is a coil tension spring and because of its general alignment with the plane of the blade 54, serves an over-center function that tends to urge blade 54 away from a central position between contacts 49 and 52 in one direction or the other so that the contact blade has a first stable position when contact 56 is in engagement with contact 52 and a second stable position when contact 55 is in engagement with fixed contact 49, achieving a bi-stable characteristic for the switch as well as its snap-action movement.

The contact blade 54 is supported, with the aid and urging of tension spring 60, in a pivot lever 65. Lever 65 is pivotally supported on a bracket portion 67 formed on the end of the post 53 that is part of the terminal 17.

Lever 65 is also bifurcated and has legs 69 and 70 that permit the spring 60 to pass freely therethrough. The ends of the legs 69 and 70 are bent around and form hooks that receive the legs 58 and 59 on the contact blade. Spring 60 urges the blade into the hooks and in this manner the contact blade is pivotally supported on lever 65 to achieve the necessary over-center action of the contact blade 54.

As the lever 65 pivots clockwise from its position shown in FIG. 5 and blade 54 passes through the axis of spring 60, spring 60 will rapidly rotate contact blade 54 in a clockwise direction, disengaging contact 56 from fixed contact 52 and engaging contact 55 with fixed contact 49.

The blade 54, lever 65 and bracket portion 67 are all electrically conductive and hence contacts 55 and 56 are electrically connected to supply terminal 16.

The lever 65 is held in axial position by a plunger 72 slidable in a cup-shaped cover 74. The plunger 72 has an upper end in engagement with and biased by the diaphragm 34 and a lower head end 75 slidably engaging the upper surface of the lever 65 as the lever 65 pivots. The cup-shaped cover 74 completes the switch assembly 12 and is carried by the body 40 with a snug fit between its counterbore 76 and a cylindrical boss 77 on body 40.

The switch assembly 12, including the body 40 with cover member 74 fixed thereto, is removable as a unit to and from the housing 11.

The switch 12, in the position shown in FIGS. 5 and 6 is in what is termed its normal position with the diaphragm 34 relaxed. In this position, switch contacts 56 and 52 are closed, so that these are termed the normally closed contacts, with terminal 17 connected to terminal 18 but not conducting. Of course in the example shown terminal 18 is disconnected so that in the normally closed position of contacts 52 and 56 there is no current flow through the switch. As sufficient water pressure is supplied to chamber 33, diaphragm 34 will move plunger 72 downwardly, causing lever 65 to rotate downwardly, disengaging contacts 56 and 52 and engaging contacts 55 and 49. In this position current flows from supply terminal 17 to terminal 16.

The switch unit 12 is axially adjustable in the housing 11 both for the purpose of initially calibrating the switch and to permit the user to vary the switch set point within a certain range in the field.

Toward this end the relative position of the threads 22 on housing 11 and the threads 46 on the base 40 is selected so that with plunger 72 always in engagement with the underside of diaphragm 34, the switch unit may be moved axially up and down from its position shown in FIG. 5 by rotation of boot 13. By moving the switch unit 12 upwardly from its position shown in FIGS. 5 and 6, the switch plunger travel to switch actuation will decrease and hence decrease the switch operating pressure, and conversely by moving the switch unit 12 downwardly the plunger travel to switch actuation will increase requiring greater water pressure in chamber 33 for switch actuation.

The boot 15 not only seals the switch unit 12 to the housing 11 but also serves as the adjusting member for varying the set point of the switch.

The boot 15 is an elastomer and may be constructed of one of the commercially available thermo-plastic rubber materials. Boot 15 has an upper annular portion 80 with an inner annular wall 81 that frictionally engages the outer surface of the housing 11 to seal the housing and also to maintain the rotationally adjusted position of the boot 15 with respect to the housing 11.

Boot 15 has a rectangular lower portion 83 with a rectangular recess 84 that surrounds, engages and locks on the terminal portion 42 of the switch 12. The boot 15 has a wedge-shaped lateral recess 85 illustrated in FIG. 5 that receives a projection 86 formed integrally on terminal portion 42, and serves to lock the boot 15 on the switch base 40. Boot lower portion 83 has integral grommets 88 that seal terminal leads 89.

The boot upper annular wall 80 has an integral pointer 90 thereon that cooperates with the indicia ring 14 to provide a visual representation of switch set point. Indicia ring 14 is annular in configuration and has a lower frustoconical wall 92 upon which indicia 93 are formed. Indicia 93 are selected to provide the appropriate range of pressure settings for the switch to match the pressure vs. travel curve for the switch. The indicia ring 14 has spaced converging walls 94 and 95 that engage the upper converging surfaces on the pointer 90 to define stops to limit rotation of the boot 15 with respect to the housing 11 in both directions.

The indicia ring 14 is pressed on the housing 11 during assembly and rotated to its 1 psi position after the boot 15 has been calibrated to its 1 psi position. The switch is then calibrated because the indicia 93 had been selected in accordance with a known pressure vs. travel curve for the switch 12.

We claim:

1. A pressure operated electric switch assembly, comprising; housing means having a flexible diaphragm therein communicating with a pressure chamber, said housing means having an inlet fitting communicating with said chamber, a self-contained switch unit axially adjustable in the housing means having an actuator in engagement with the diaphragm, said switch unit having a portion thereof projecting from the housing means with an indicator thereon, indicia representing pressure mounted on the outside of the housing means adjacent the indicator, and interengaging means on the housing means and the switch unit to produce incremental axial movement of the switch unit in the housing means to vary the diaphragm travel required for switch unit actuation and to move the indicator with respect to the indicia and provide the operator with a visual representation of switch actuation pressure, said interengaging means between the housing means and the switch unit including interengaging threads whereby upon rotation of the switch unit relative to the housing means the switch unit moves axially in the housing means to vary switch actuation pressure, said indicator being carried by an elastomeric boot covering and sealing the projecting portion of the switch unit to the housing means.

2. A pressure operated electric switch assembly comprising; housing means having a flexible diaphragm therein communicating with a pressure chamber, said housing means having an inlet fitting communicating with said chamber, a self-contained switch unit axially adjustable in the housing means having an actuator in engagement with the diaphragm, said switch unit having a portion thereof projecting from the housing means with an indicator thereon, indicia representing pressure mounted on the outside of the housing means adjacent the indicator, interengaging means on the housing means and the switch unit to produce incremental axial movement of the switch unit in the housing means to vary the diaphragm travel required for switch unit actuation and to move the indicator with respect to the indicia and provide the operator with a visual representation of switch actuation pressure, said projecting portion of the switch unit carrying terminals electrically connected to contacts in the switch unit, and an elastomeric boot covering and sealing the projecting portion of the switch unit to the housing means, said indicator having a pointer formed integrally with the boot, said indicia being formed on a ring surrounding and fixed to the housing means.

3. A pressure operated electric switch assembly, comprising; housing means having a flexible diaphragm therein communicating with a pressure chamber, said housing means having an inlet fitting communicating with said chamber, a self-contained switch unit axially adjustable in the housing means having an actuator in engagement with the diaphragm, said switch unit having a portion thereof projecting from the housing means with an indicator thereon, indicia representing pressure mounted on the outside of the housing means adjacent the indicator, interengaging threads on the switch unit and the housing means whereby on relative rotation thereof the switch unit may be adjustably positioned in the housing means, to vary the diaphragm travel required for switch unit actuation and to move the indicator with respect to the indicia and provide the operator with a visual representation of switch actuation pressure, and a cup shaped elastomeric boot covering and sealing the projecting portion of the switch unit in the housing means, said boot having an annular portion thereof frictionally engaging the outside of the housing means to seal the housing means and rotationally position the switch unit with respect to the housing means, said indicator being a pointer formed integrally with the boot.

4. A pressure operated electric switch assembly, comprising; a housing having a chamber therein communicating with an inlet fitting, a diaphragm mounted in the chamber subjected to chamber pressure, a switch unit in the housing connected to be actuated by the diaphragm, said switch unit being a snap-action switch with an axially movable actuation plunger, said switch unit being axially movable in the direction of the plunger to vary the diaphragm travel required for switch actuation, said switch unit having a terminal portion projecting from the housing, indicia on the housing representing pressure, and an elastomeric member on the terminal portion having an annular portion frictionally engaging and sealing the housing to frictionally hold the switch unit in an adjusted position relative to the housing, said elastomeric member having an indicator thereon that cooperates with the indicia on the housing to provide a visual representation of switch actuation pressure.

5. A pressure operated electric switch assembly as defined in claim 4, wherein said elastomeric member is a boot encircling and sealing the terminal portion of the switch unit to the housing.

6. A pressure operated electric switch assembly as defined in claim 4, wherein the switch unit includes a base threadedly engaging the housing so that upon relative rotation the switch unit will move axially in the housing, said terminal portion extending downwardly from the base.

7. A pressure operated electric switch assembly as defined in claim 4, wherein said indicia are formed on a ring press fitted around the housing.

* * * * *